US012022911B2

(12) United States Patent
Verpillot

(10) Patent No.: US 12,022,911 B2
(45) Date of Patent: Jul. 2, 2024

(54) INSOLE

(71) Applicant: Annette Verpillot, Montreal (CA)

(72) Inventor: Annette Verpillot, Montreal (CA)

( * ) Notice: Subject to any disclaimer, the term of this patent is extended or adjusted under 35 U.S.C. 154(b) by 159 days.

(21) Appl. No.: 17/661,673

(22) Filed: May 2, 2022

(65) Prior Publication Data

US 2022/0346498 A1 Nov. 3, 2022

Related U.S. Application Data

(60) Provisional application No. 63/182,343, filed on Apr. 30, 2021.

(51) Int. Cl.

| | |
|---|---|
| ***A43B 7/14*** | (2022.01) |
| ***A43B 7/1405*** | (2022.01) |
| ***A43B 7/142*** | (2022.01) |
| ***A43B 7/1455*** | (2022.01) |
| ***A43B 17/00*** | (2006.01) |
| ***A43B 17/04*** | (2006.01) |
| ***A43B 17/14*** | (2006.01) |

(52) U.S. Cl.

CPC ..... *A43B 17/006* (2013.01); *A43B 7/1405* (2013.01); *A43B 7/141* (2013.01); *A43B 7/142* (2013.01); *A43B 7/146* (2013.01); *A43B 17/04* (2013.01); *A43B 17/14* (2013.01)

(58) Field of Classification Search

CPC ..... A43B 17/006; A43B 7/1405; A43B 7/146
USPC ..... 36/141
See application file for complete search history.

(56) References Cited

U.S. PATENT DOCUMENTS

| | | | | |
|---|---|---|---|---|
| 628,699 | A | 7/1899 | Damrell | |
| 4,033,054 | A | 7/1977 | Fukuoka | |
| 4,747,410 | A | 5/1988 | Cohen | |
| 4,760,655 | A * | 8/1988 | Mauch | A43B 7/146 36/43 |
| 5,158,526 | A | 10/1992 | Bricot | |
| 5,468,324 | A | 11/1995 | Hong | |
| 5,551,173 | A * | 9/1996 | Chambers | A43B 7/146 36/141 |
| 5,976,100 | A | 11/1999 | Greenawalt | |
| 6,148,822 | A | 11/2000 | Cron et al. | |

(Continued)

FOREIGN PATENT DOCUMENTS

| | | | |
|---|---|---|---|
| CN | 202890659 | U | 4/2013 |
| CN | 104352023 | A | 2/2015 |

(Continued)

*Primary Examiner* — Marie D Bays
(74) *Attorney, Agent, or Firm* — Simpson & Simpson, PLLC

(57) ABSTRACT

An insole having, a base layer, a top layer fixedly secured to the base layer, a middle layer comprised of the base layer and the top layer positioned between the base layer and the top layer, a pressure projection extending upwardly from within the middle layer and extending past an upper surface of the upper layer, the projection including a disc fixedly secured within the middle layer, an annular ring fixedly secured atop the disc, a circular metal insert fixedly secured atop the disc within the annular ring, the circular metal insert having a horseshoe-shaped aperture therein. The insole may also include projections either positioned proximate an inside arch and/or positioned proximate an outside arch. The insole may also comprise a projection positioned proximate to a midfoot region.

5 Claims, 9 Drawing Sheets

(56) References Cited

U.S. PATENT DOCUMENTS

| | | | | |
|---|---|---|---|---|
| 6,234,987 | B1 * | 5/2001 | Chen | A61H 23/02 36/141 |
| 6,461,375 | B1 | 10/2002 | Baudry et al. | |
| 6,510,626 | B1 | 1/2003 | Greenawalt | |
| 6,773,391 | B1 | 8/2004 | Bricot | |
| 7,913,428 | B2 | 3/2011 | Wang | |
| 8,879,685 | B2 | 11/2014 | Oshio | |
| D729,509 | S | 5/2015 | Lee | |
| D753,908 | S | 4/2016 | Vasyli | |
| 9,943,132 | B1 | 4/2018 | Tsai | |
| D863,745 | S | 10/2019 | Fromholtz et al. | |
| D863,746 | S | 10/2019 | Fromholtz et al. | |
| 11,297,894 | B1 * | 4/2022 | Yang | A43B 7/149 |
| 11,452,330 | B1 * | 9/2022 | Nasibyan | A61H 15/00 |
| 2008/0184594 | A1 * | 8/2008 | Ebeling | A43B 13/14 36/141 |
| 2011/0173842 | A1 * | 7/2011 | Hong | A43B 7/146 36/91 |
| 2011/0289798 | A1 * | 12/2011 | Jung | A43B 7/146 36/91 |
| 2013/0167403 | A1 * | 7/2013 | Kitagawa | A43B 7/1425 36/43 |
| 2015/0143714 | A1 * | 5/2015 | Tzeng | A43B 7/143 36/43 |
| 2018/0235827 | A1 | 8/2018 | Rich | |
| 2018/0318595 | A1 | 11/2018 | Martinez | |
| 2020/0008522 | A1 | 1/2020 | Kim | |
| 2020/0093675 | A1 * | 3/2020 | Hale | A61H 1/0266 |

FOREIGN PATENT DOCUMENTS

| | | | |
|---|---|---|---|
| DE | 29510949 | U1 | 9/1995 |
| EP | 1218058 | B1 | 11/2005 |
| FR | 2873917 | A1 | 2/2006 |
| JP | 3207665 | U | 11/2016 |
| KR | 200232580 | Y1 | 10/2001 |
| WO | 2019227555 | A1 | 12/2019 |

* cited by examiner

INSOLE

CROSS-REFERENCE TO RELATED APPLICATIONS

This application, under 35 U.S.C. § 119, claims the benefit of and priority to U.S. Provisional Application No. 63/182,343, filed on Apr. 30, 2021, entitled "Orthotic Insole", and is incorporated herein by reference in its entirety.

FIELD

The present invention relates generally to an insole, and more particularly to an insole that increases the surface area of the foot to provide comfort and support, thereby enabling a user to correct coordination and postural imbalances.

BACKGROUND

Poor postural and body alignment can have a negative impact on one's physical and mental health. Most of the population experiences postural imbalances because of lifestyle choices and unconscious slouching. Continuous poor posture can cause several diseases and disorders with debilitating effects.

Research has proven that sensory foot stimulation can combat postural imbalances. The feet play a major role in allowing one to have awareness of the position and movement of his or her body. This concept is known as proprioception. A classic example of proprioception is when the feet sense that they are on sand or hard cement, and in turn, adjust the position of the body to prevent one from falling. The signals the feet receive from external stimuli comes from the somatosensory system. The somatosensory system is part of the sensory system and allows one to consciously perceive touch, pressure, movement, vibration, position, etc. As the body perceives signals through the feet, sensory neurons transmit responses to the brain to change body alignment.

Most conventional support insoles provide cushioned arch support to the foot when the user moves. These devices provide comfort to the user, but do not continuously correct the user's coordination and postural imbalances while the user is both weight-bearing and non-weight-bearing.

Moreover, conventional sensory insoles stimulate foot receptors through electric currents, electromagnetic waves, or electromagnetic fields controlled by a device placed within the insole or an external device placed near the heel of a shoe. These conventional designs often incorporate wires, circuits, or batteries that create a thick insole that includes all the electronics needed to operate within, or a thin insole with an external housing unit for the electronic components. The art lacks a sensory insole that uses the physiological reflex zones of the foot to stimulate receptors.

Thus, there is a long-felt need for an insole that provides continuous support for the foot and stimulates the sensory receptors of the foot to correct postural imbalances to improve foot alignment and coordination.

SUMMARY

The present invention broadly comprises an insole having a base layer, a top layer fixedly secured to the base layer, a middle layer comprised of the base layer and the top layer positioned between the base layer and the top layer, a pressure projection extending upwardly from within the middle layer and extending past an upper surface of the upper layer, the projection including a disc fixedly secured within the middle layer, an annular ring fixedly secured atop the disc, a circular metal insert fixedly secured atop the disc within the annular ring, the circular metal insert having a horseshoe-shaped aperture therein.

The present invention may also broadly comprise an insole having a base layer, a top layer fixedly secured to the base layer, a middle layer comprised of the base layer and the top layer positioned between the base layer and the top layer, a pressure projection extending upwardly from within the middle layer and extending past an upper surface of the upper layer, the projection including a disc fixedly secured within the middle layer, an annular ring fixedly secured atop the disc, a circular metal insert fixedly secured atop the disc within the annular ring, the circular metal insert having a horseshoe-shaped aperture therein, and a pair of projections, one of said pair of projections positioned proximate an inside arch and one of the pair of projections positioned proximate an outside arch, the pair of projections proximate to a hindfoot region.

The present invention may further comprise a base layer, a top layer fixedly secured to the base layer, a middle layer comprised of the base layer and the top layer positioned between the base layer and the top layer and, a pair of projections, one of the pair of projections positioned proximate an inside arch and one of the pair of projections positioned proximate an outside arch, the pair of projections proximate a hindfoot region, where the inside projection and the outside projection form a wedge on the top layer.

The present invention may still further comprise a base layer, a top layer fixedly secured to the base layer, a middle layer comprised of the base layer and the top layer positioned in between the base layer and the top layer, a projection positioned proximate to an inside arch of a hindfoot region, the projection extending from the top layer and a projection positioned proximate to a midfoot region, the projection of the midfoot region extending from the top layer, where the inside projection and the projection of the midfoot region form a wedge proximate the midfoot region on the top layer.

An object of this insole is to improve the brain-body connection through sensory receptors. The activation of sensory receptors improves feet alignment and corrects postural imbalances. The frequency and vibration resonator in the center of the insole comprised of a disc, zinc annular ring and copper insert with a horseshoe-shaped aperture, stimulates the receptors within the feet as they respond to pressure, stretch, and frequency. The signal from the feet travels through ascending sensory pathways to the brain and arrives at the sensory cortex. The signal then transmits to the motor cortex where the brain adjusts the position of the body. The center projection increases the surface area on the foot to increase sensory feedback. This increased sensory feedback gives the body continuous awareness of its position in space to improve alignment of the feet to correct the position of the knee, hip, or back to improve posture.

This and other objects, features, and advantages of the present disclosure will become readily apparent upon a review of the following detailed description of the disclosure, in view of the drawings and appended claims.

BRIEF DESCRIPTION OF THE DRAWINGS

Various embodiments are disclosed, by way of example only, with reference to the accompanying schematic drawings in which corresponding reference symbols indicate corresponding parts, in which.

DETAILED DESCRIPTION

Figure 1A:
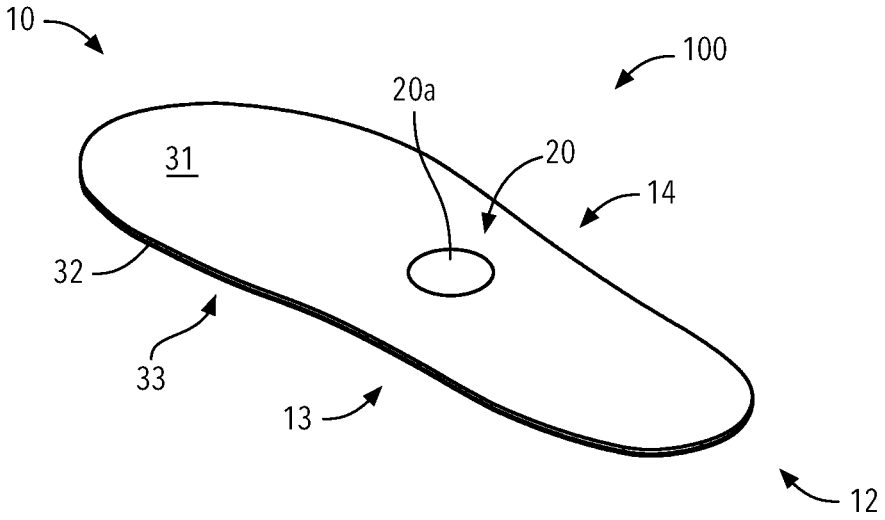
FIG. 1A is a top perspective view of a first embodiment of present invention.

At the outset, it should be appreciated that like drawing numbers on different drawing views identify identical, or functionally similar, structural elements. It is to be understood that the claims are not limited to the disclosed aspects.

Furthermore, it is understood that this disclosure is not limited to the particular methodology, materials and modifications described and as such may, of course, vary. It is also understood that the terminology used herein is for the purpose of describing particular aspects only and is not intended to limit the scope of the claims.

Unless defined otherwise, all technical and scientific terms used herein have the same meaning as commonly understood to one of ordinary skill in the art to which this disclosure pertains. It should be understood that any methods, devices or materials similar or equivalent to those described herein can be used in the practice or testing of the example embodiments.

It should be appreciated that the term "substantially" is synonymous with terms such as "nearly," "very nearly," "about," "approximately," "around," "bordering on," "close to," "essentially," "in the neighborhood of," "in the vicinity of" etc., and such terms may be used interchangeably as appearing in the specification and claims. It should be appreciated that the term "proximate" is synonymous with terms such as "nearby," "close," "adjacent," "neighboring," "immediate," "adjoining," etc., and such terms may be used interchangeably as appearing in the specification and claims.

The insole of the present invention, described herein, includes four (4) different embodiments where each embodiment is geared to assist a user based on different physical ailments.

The first embodiment of the insole generally comprises a base layer, a pressure projection and a top layer. The base layer and top layer are preferably made using Polyurethane and Polyamide (Nylon 66). The pressure projection comprises a preferably plastic or polymer comprised disc fixedly secured to the base layer, a zinc annular ring fixed secured atop the disc, and a copper circular metal insert with a horseshoe-shaped aperture fixedly secured atop the disc within the annular ring. The pressure projection is embedded within the base layer and the top layer, i.e., a middle layer positioned between the top and bottom layers. The base layer and the top layer are adhered with double sided adhesive tape in a preferred embodiment, however, alternative fixation means may be contemplated.

The second embodiment of the insole generally comprises a base layer, a pressure projection and a top layer. The base layer and top layer are preferably made using Polyurethane and Polyamide (Nylon 66). The pressure projection has two components. The first component comprises a preferably plastic or polymer comprised disc fixedly secured to the base layer, a zinc annular ring fixed secured atop the disc, and a copper circular metal insert with a horseshoe-shaped aperture fixedly secured atop the disc within the annular ring. The second component comprises two upwardly facing projections positioned proximate to the inside arch and proximate to the outside arch of the hindfoot region. The pressure projection having the metal insert are preferably embedded within the base layer and the top layer, i.e., a middle layer positioned between the top and bottom layers. Alternatively, both projections located proximate the inside arch and the outside arch may extend upwardly from the top layer, fixedly secure thereto or may be integrally formed with the top layer and middle and arranged to extend upwardly. Alternatively, both projections located proximate the inside arch and the outside arch may be embedded within the middle layer and arranged to extend upwardly past the surface of the top layer. The base layer and the top layer are adhered with double sided adhesive tape in a preferred embodiment, however, alternative fixations means may be contemplated. Both of the projections located proximate the inside arch and the outside arch are further arranged to form a wedge positioned on the top layer. Alternatively, both projections may be separate material extending from the middle layer and covered by the top layer thereon.

The third embodiment of the insole generally comprises a base layer, a pressure projection and a top layer. The base layer and top layer are preferably made using Polyurethane and Polyamide (Nylon 66). The insole also comprises two upwardly facing projections positioned proximate to the inside arch and proximate to the outside arch of the hindfoot region. Both projections located proximate the inside arch and the outside arch may extend upwardly from the top layer, fixedly secure thereto or may be integrally formed with the top layer and middle and arranged to extend upwardly. Alternatively, both projections located proximate the inside arch and the outside arch may be embedded within the middle layer and arranged to extend upwardly past the surface of the top layer. The base layer and the top layer are adhered with double sided adhesive tape in a preferred embodiment, however, alternative fixations means may be contemplated. Both of the projections located proximate the inside arch and the outside arch are further arranged to form a wedge positioned on the top layer. Alternatively, both projections may be separate material extending from the middle layer and covered by the top layer thereon.

The fourth embodiment of the insole generally comprises a base layer, a middle layer, and a top layer, where the middle layer positioned between the top and bottom layers. The base layer, projections and top layer are preferably made using Polyurethane and Polyamide (Nylon 66). Both projections may extend upwardly from the top layer, fixedly secure thereto or may be integrally formed with the top layer and middle and arranged to extend upwardly. Alternatively, both projections may be embedded within the middle layer and arranged to extend upwardly past the surface of the top layer. The base layer and the top layer are adhered with double sided adhesive tape in a preferred embodiment, however, alternative fixation means may be contemplated. Both of the projections located are further arranged to form a wedge positioned on the top layer, proximate the midfoot region. The projections may be embedded within the base layer and the top layer. Alternatively, both projections may extend upwardly from the top layer, fixedly secure thereto. Alternatively, both projections may be separate material extending from the middle layer and covered by the top layer thereon.

Figure 1B:
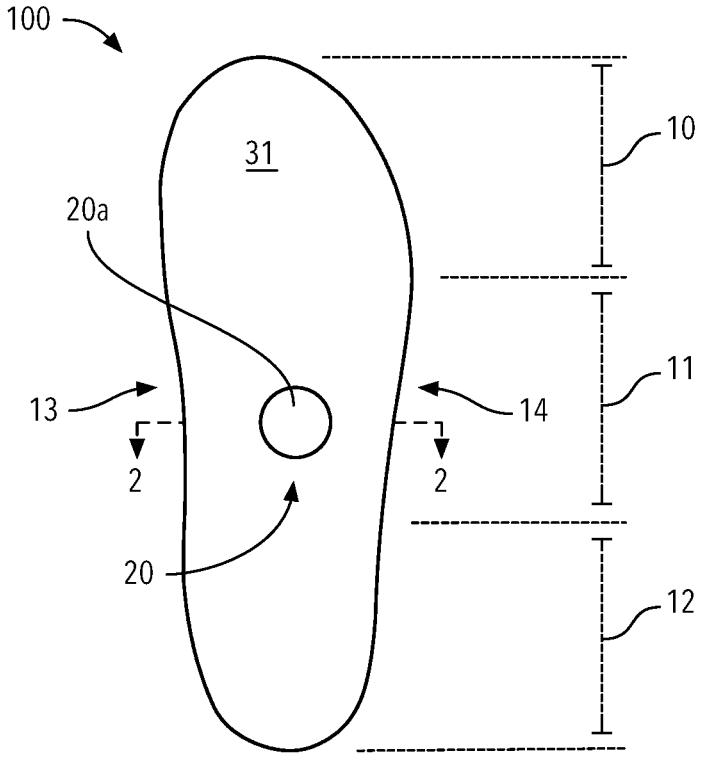
FIG. 1B is a top view of the invention shown in FIG. 1.

Adverting now to the figures, the following description should be taken in view of FIGS. 1A and 1B, specifically illustrating the first embodiment of the present invention. FIG. 1A illustrates a top perspective of the first embodiment of insole 100 with pressure projection 20 embedded therein and FIG. 1B illustrates a top view of the first embodiment of insole 100. Pressure projection 20 is embedded within the respective layers of insole 100, i.e., base layer 33 (shown in FIG. 2), middle layer 32, and top layer 31. Base layer 33 is adhered to top layer 31 via double-sided adhesive tape, although it should be appreciated that various other methods of binding the base layer and the top layer may be employed, e.g., heat lamination, or other suitable means. Middle layer 32 is located between top layer 31 and bottom layer 33. Top layer 31 includes bulge 20*a* which covers, or contains, pressure projection 20 within base layer 33 and middle layer 32. It should be appreciated that middle layer 32 is illustrated to depict the material between base layer 33 and top layer 31 (shown in greater detail in view of FIG. 2).

Insole 100 is defined by forefoot region 10, midfoot region 11, and hindfoot region 12. Specifically, forefoot region 10 is defined by the toes of the foot of the user, that is, the area where the toes will rest thereon, midfoot region 11 is defined by the arch of the foot of the user and where pressure projection 20 is preferably located, and hindfoot region 12, defined by the heal of the foot of a user, that is, the area where the heal will rest thereon. In a preferred embodiment, pressure projection 20 is embedded within midfoot region 11 and is further arranged to extend upwardly past the upper surface of top layer 31. Insole 100 includes two sides, inside arch 13 and outside arch 14, where inside arch 13 would be arranged proximate to the inside arch of a user's foot resting on insole 100 and where outside arch 14 would be arranged proximate to the outside arch of a user's foot resting on insole 100.

Figure 2:
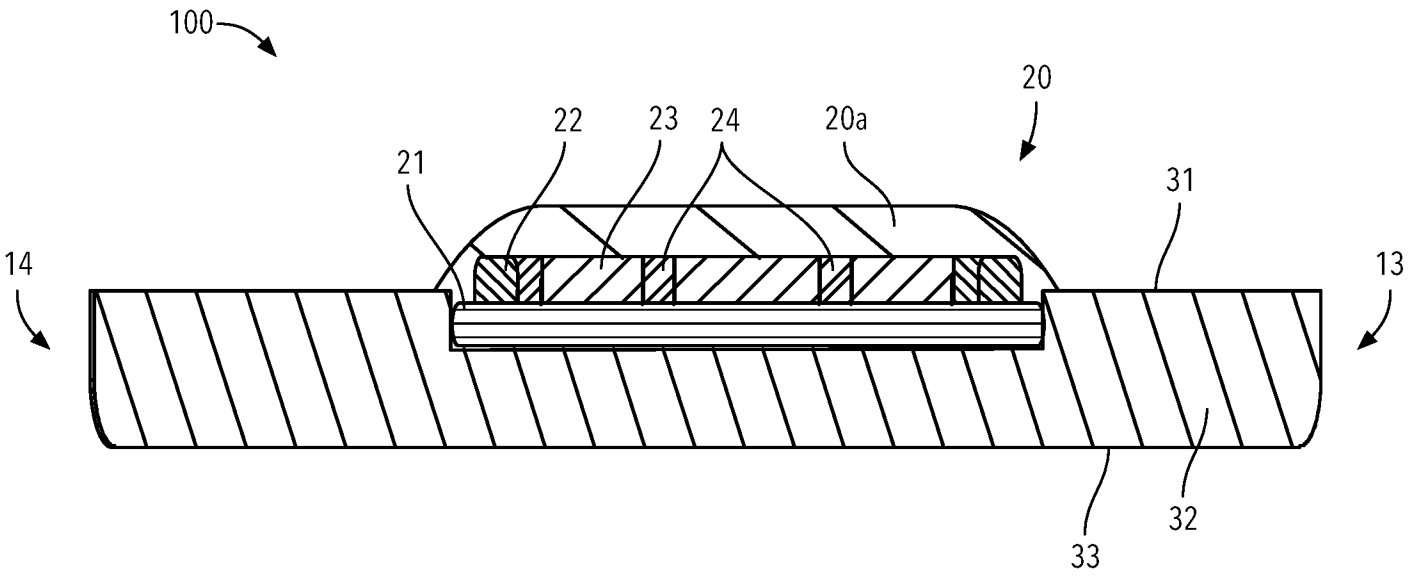
FIG. 2 is a cross-sectional view taken generally along line 2-2 shown in FIG. 1B.
Figure 3A:
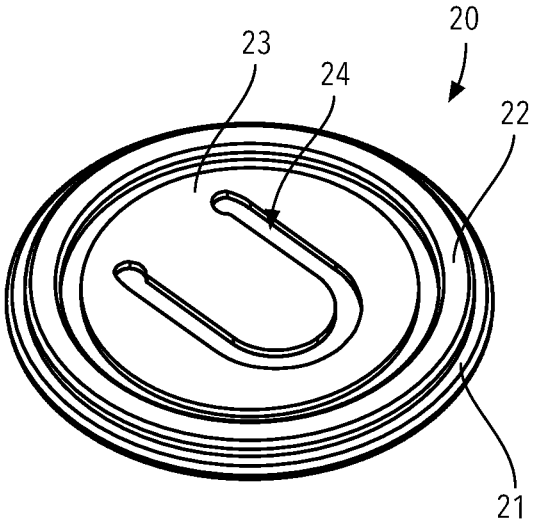
FIG. 3A is a top perspective view of pressure projection 20 of the present invention.
Figure 3B:
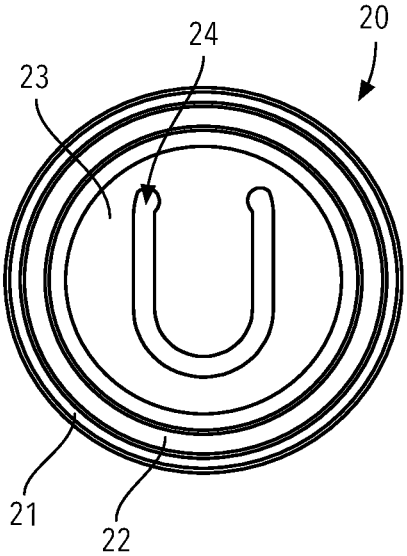
FIG. 3B is a top view of pressure projection 20 shown in FIG. 3A.
Figure 3C:
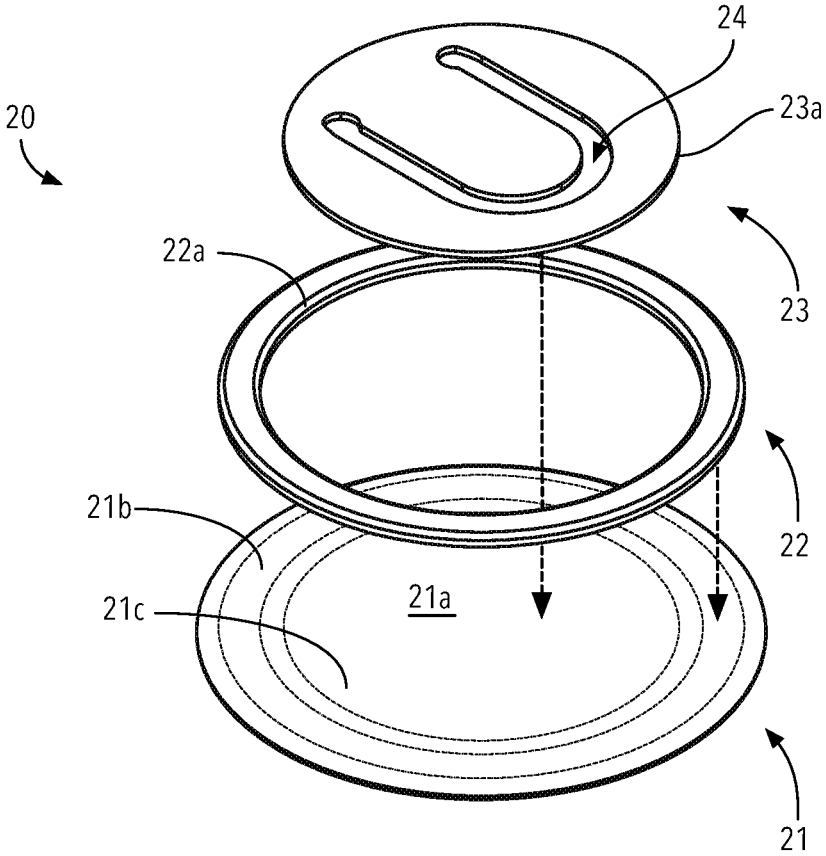
FIG. 3C is an exploded view of pressure projection 20.

The following description should be taken in view of FIGS. 2-3C. FIG. 2 is a cross-sectional view of insole 100 taken generally along line 2-2 shown in FIG. 1B. FIG. 3A is a perspective view of pressure projection 20 removed from insole 100 and FIG. 3B is a top view of the same. FIG. 3C is an exploded view of pressure projection 20. Bulge 20*a* will have deformable properties such that when a user contacts their foot to insole 100, bugle 20*a* will collapse inwardly, that is, in the direction towards bottom layer 33, such that the sole of a user's foot will indirectly contact pressure protrusion 20. As shown in FIG. 2, pressure projection 20 is embedded within insole 100, specifically within middle layer 32 and preferably arranged proximate to top layer 31. It should be appreciated that annular ring 22 and metal insert 23 have a top surface that extends past top layer 31, that is, the respective top surfaces of annular ring 22 and metal insert 23 protrude past top layer 31 such that they are raised surfaces in relation to top surface 31.

Pressure projection 20 includes base 21, annular ring 22 and metal insert 23. Metal insert 23 comprises horseshoe-shaped aperture 24 that is preferably configured in a substantially central location within metal insert 23. When pressure projection 20 is fully assembled, annular ring 22 is fixedly secured to upper surface 21*a* of base 21, specifically annular ring 22 is fixedly secured to attachment location 21*b* of upper surface 21*a*. Base 21 preferably has an outer diameter that is greater than the outer diameter of annular ring 22, such that when annular ring 22 is fixed to base 21 an outer ledge is formed on upper surface 21*a* of base 21 that extends outwardly from the outer diameter of annular ring 22. When pressure projection 20 is fully assembled, metal insert 23 is fixedly secured to upper surface 21*a* of base 21 within inner edge 22*a* of annular ring 22, specifically metal insert 23 is fixedly secured to attachment location 21*c* of upper surface 21*a* where outer edge 23*a* of metal insert 23 is within inner edge 22*a* of annular ring 22. Metal insert 23 includes a substantially central located aperture, horseshoe-shaped aperture 24, where aperture 24 in a preferred embodiment comprises a U-like, or horseshoe-shaped, configuration. In a preferred embodiment, annular ring 22 is comprised of solid zinc. In a preferred embodiment, metal insert 23 is comprised of solid copper.

Figure 4A:
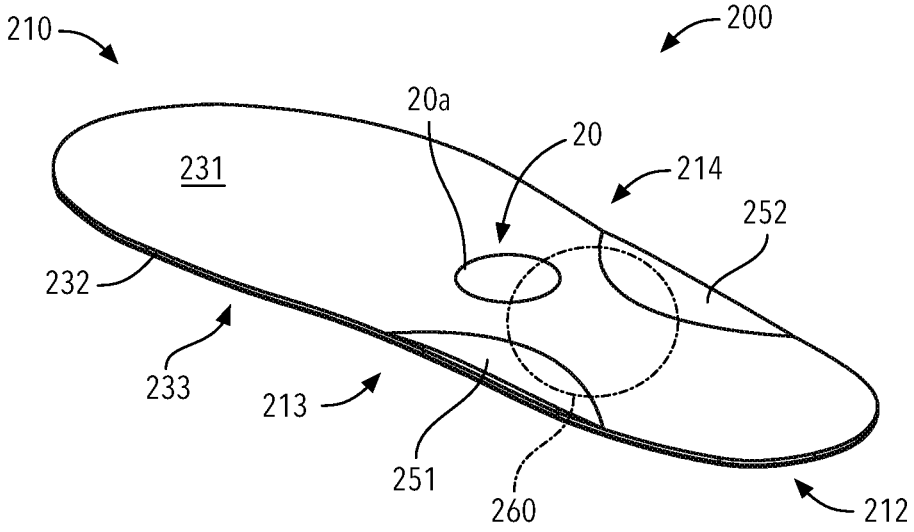
FIG. 4A is a top perspective view of a second embodiment of the present invention.
Figure 4B:
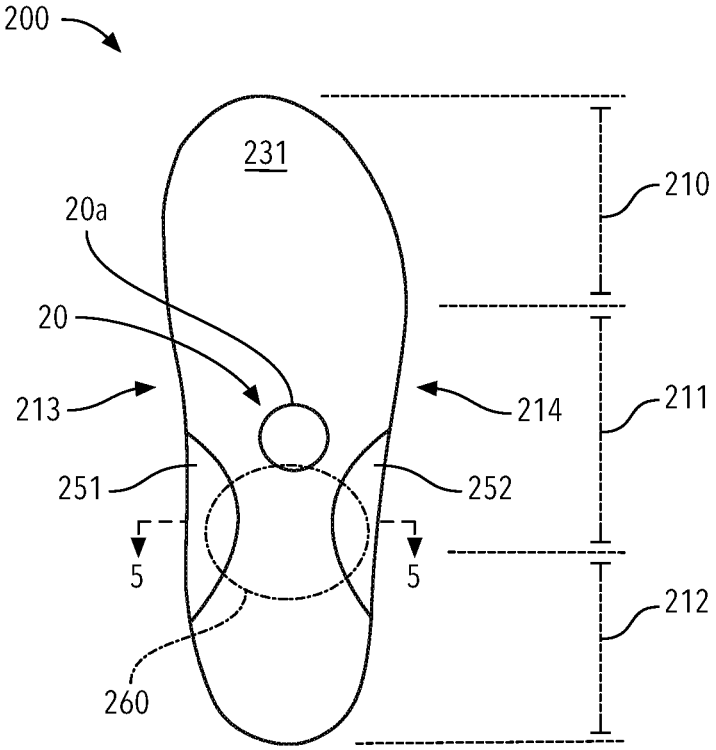
FIG. 4B is a top view of the invention shown in FIG. 4A.
Figure 5A:
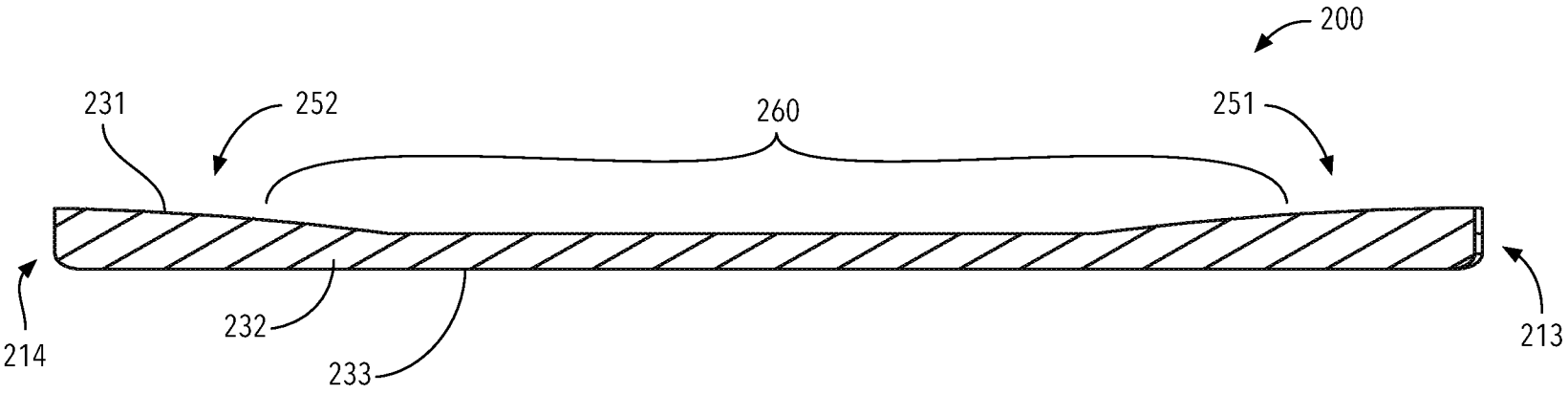
FIG. 5A is a cross-sectional view taken generally along line 5-5 shown in FIG. 4B.
Figure 5B:
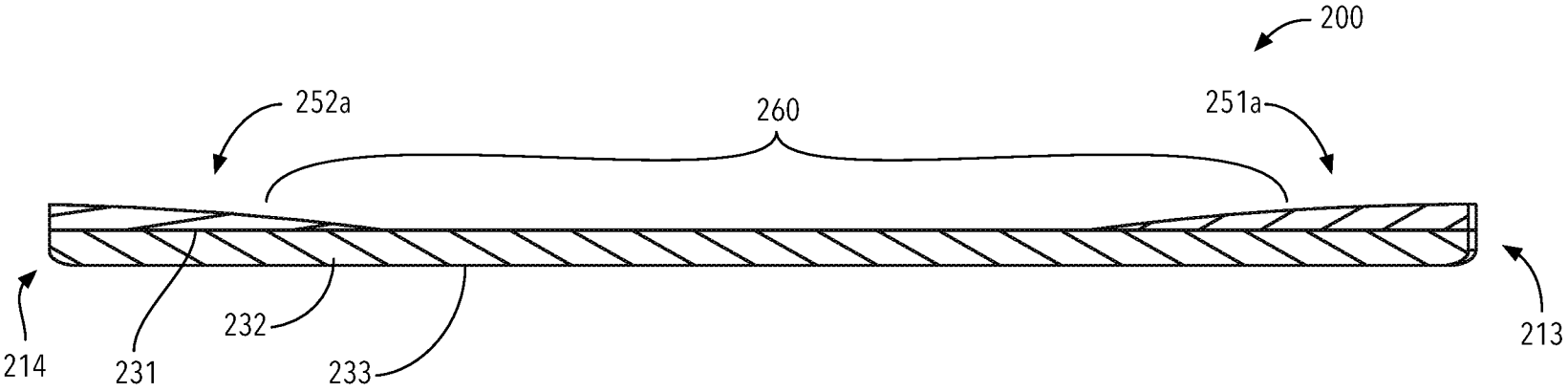
FIG. 5B is a cross-sectional view taken generally along line 5-5 shown in FIG. 4B specifically illustrating inside arch projection 251*a* and outside arch projection 252*a;*

Adverting now to the second embodiment of the present invention, insole 200 is illustrated in FIGS. 4A-5B. FIG. 4A illustrates a perspective view of insole 200 and FIG. 4B illustrates a top view of insole 200. FIGS. 5A and 5B illustrate a cross-sectional view of insole 200 taken generally along line 5-5 in FIG. 4B. Pressure projection 20 is embedded within the respective layers of insole 200, i.e., base layer 233 (shown in FIGS. 5A and 5B), middle layer 232, and top layer 231. Base layer 233 and middle layer 232 are adhered to top layer 231 via a double-sided adhesive tape, although it should be appreciated that various other methods of binding the base layer and the top layer may be employed, e.g., heat lamination, or other suitable means. Top layer 231 includes bulge 20*a* which covers, or contains, pressure projection 20 within base layer 233 and middle layer 232. It should be appreciated that middle layer 232 is illustrated to depict the material between base layer 233 and top layer 231 (shown in greater detail in view of FIGS. 5A and 5B). Pressure projection 20 and bulge 20*a* of insole 200 are of the same construction as that of insole 100, as described supra, and shown in greater detail in view of FIGS. 3A-3C.

Insole 200 is defined by forefoot region 210, midfoot region 211, and hindfoot region 212. Specifically, forefoot region 210 is defined by the toes of the foot of the user, that is, the area where the toes will rest thereon, midfoot region 211 is defined by the arch of the foot of the user and where pressure projection 20 is preferably located, and hindfoot region 212, defined by the heal of the foot of a user, that is, the area where the heal will rest thereon. In a preferred embodiment, pressure projection 20 is embedded within midfoot region 211. Insole 200 includes two sides, inside arch 213 and outside arch 214, where inside arch 213 would be arranged proximate to the inside arch of a user's foot resting on insole 200 and where outside arch 214 would be arranged proximate to the outside arch of a user's foot resting on insole 200.

Insole 200 also comprises inside arch projection 251 and outside arch projection 252. Both arch projections 251 and 252 have a substantially semicircular configuration, a semi-domed configuration, or a combination thereof. Inside arch projection 251 and outside arch projection 252 are preferably located in insole 200 proximate to hindfoot region 212 and partially within midfoot region 211 of insole 200.

Arch projections 251 and 252 could be integral with top layer 231 and middle layer 232, as shown in FIG. 5A. Alternatively, inside arch projection 251*a* and outside arch projection 252*a* could be separate components that are affixed to top layer 231, as shown in FIG. 5B.

The difference between insole 100 and insole 200 is the presence of inside arch projection 251 (or 251*a*) and outside arch projection 252 (or 252*a*), discussed supra. Inside arch projection 251 and outside arch projection 252 are preferably positioned in between the midfoot region 211 and hindfoot region 212, where inside arch projection 251 is configured on inside arch 213 and outside arch projection 252 is specifically configured on outside arch 214, thereby contacting the inside arch and outside arch of a user's foot that is resting on insole 200. Inside arch projection 251 (or 251*a*) and outside arch projection 252 (or 252*a*) form wedge 260, which is a combination of top layer 231, inside arch projection 251 (or 251*a*) and outside arch projection 252 (or 252*a*). The benefits imparted by the configuration of wedge 260 are described in greater detail, infra.

Figure 6A:
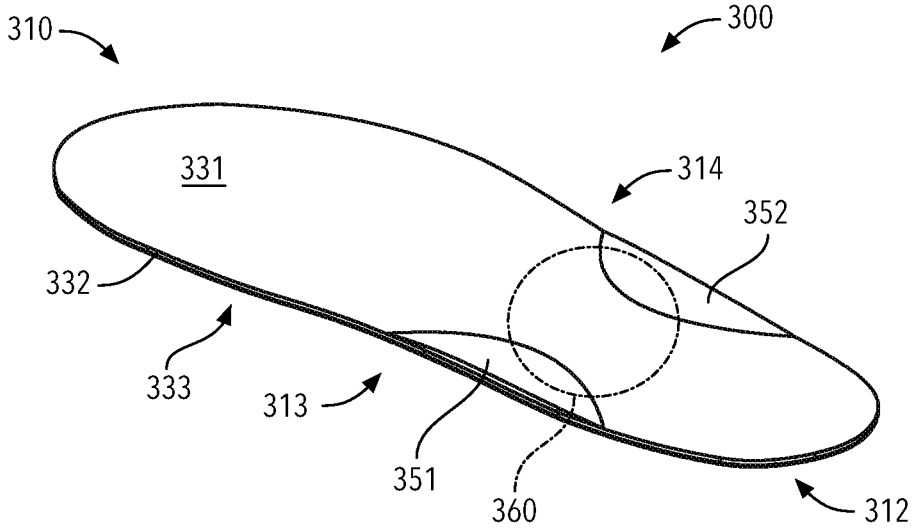
FIG. 6A is a top perspective view of a third embodiment of the present invention.
Figure 6B:
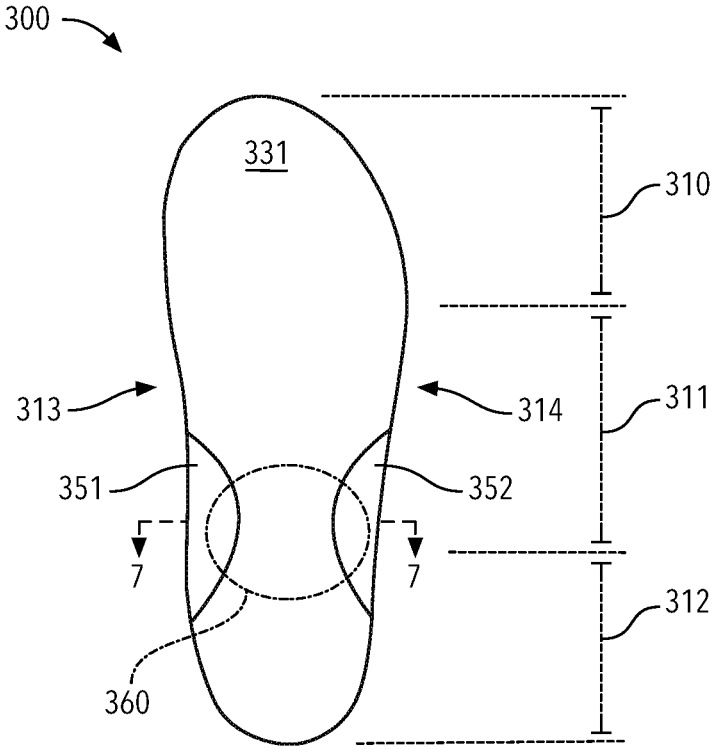
FIG. 6B is a top view of the invention shown in FIG. 6A.
Figure 7A:
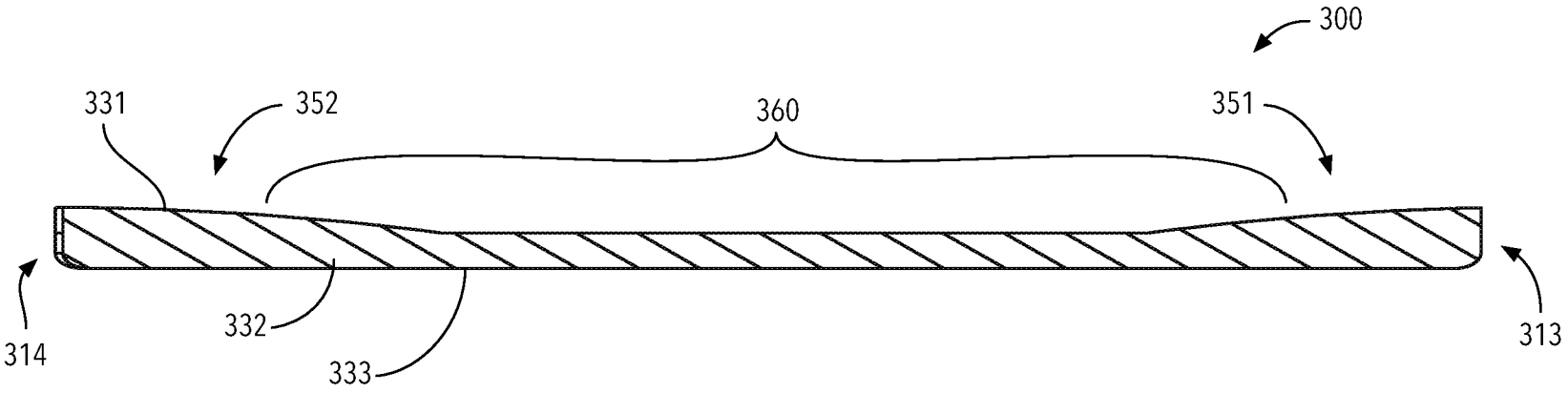
FIG. 7A is a cross-sectional view taken generally along line 7-7 shown in FIG. 6B
Figure 7B:
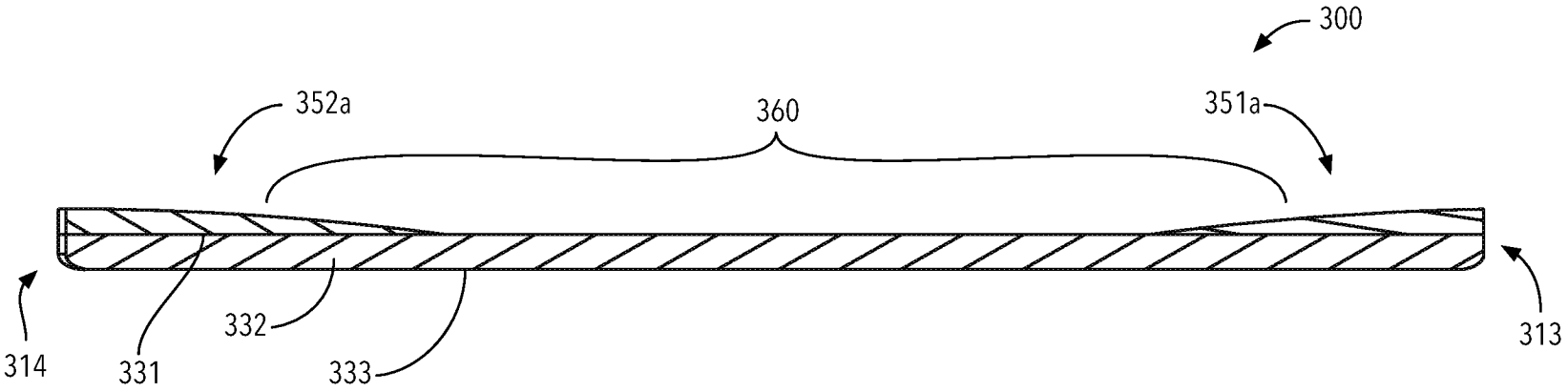
FIG. 7B is a cross-sectional view taken generally along line 7-7 shown in FIG. 6B specifically illustrating inside arch projection 351*a* and outside arch projection 352*a;*

Adverting now to the third embodiment of the present invention, insole 300. The following description should be taken in view of FIGS. 6A-7B. FIG. 6A illustrates a perspective view of insole 300 and FIG. 6B illustrates a top view of insole 300. FIGS. 7A and 7B illustrate a cross-sectional view of insole 300 taken generally along line 7-7 in FIG. 6B. Base layer 333 and middle layer 332, are adhered to top layer 331 via a double-sided adhesive tape, although it should be appreciated that various other methods of binding the base layer and the top layer may be employed, e.g., heat lamination, or other suitable means. It should be appreciated that middle layer 332 is illustrated to depict the material between base layer 333 and top layer 331 (shown in greater detail in view of FIGS. 7A and 7B).

Insole 300 is defined by forefoot region 310, midfoot region 311, and hindfoot region 312. Specifically, forefoot region 310 is defined by the toes of the foot of the user, that is, the area where the toes will rest thereon, midfoot region 311 is defined by the arch of the foot of the user and hindfoot region 312, defined by the heal of the foot of a user, that is, the area where the heal will rest thereon. Insole 300 includes two sides, inside arch 313 and outside arch 314, where inside arch 313 would be arranged proximate to the inside arch of a user's foot resting on insole 300 and where outside arch 314 would be arranged proximate to the outside arch of a user's foot resting on insole 300.

Insole 300 also comprises inside arch projection 351 and outside arch projection 352. Both arch projections 351 and 352 have a substantially semicircular configuration, a semi-domed configuration, or a combination thereof. Inside arch projection 351 and outside arch projection 352 are preferably located in insole 300 proximate to hindfoot region 312 and partially within midfoot region 311 of insole 300.

Arch projections 351 and 352 could be integral with top layer 331 and middle layer 332, as shown in FIG. 7A. Alternatively, inside arch projection 351*a* and outside arch projection 352*a* could be separate components that are affixed to top layer 331, as shown in FIG. 7B.

The difference between insole 100 and insole 300 is the presence of inside arch projection 351 (or 351*a*) and outside arch projection 352 (or 352*a*), and the absence of pressure projection 20, discussed supra. Inside arch projection 351 and outside arch projection 352 are preferably positioned in between the midfoot region 311 and hindfoot region 312, where inside arch projection 351 is configured proximate to inside arch 313 and outside arch projection 352 is specifically configured proximate to outside arch 314, thereby contacting the inside arch and outside arch of a user's foot that is resting on insole 300. Inside arch projection 351 (or 351*a*) and outside arch projection 352 (or 352*a*) form wedge 360, which is a combination of top layer 331, inside arch projection 351 (or 351*a*) and outside arch projection 352 (or 352*a*). The benefits imparted by the configuration of wedge 360 are described in greater detail, infra.

Figure 8A:
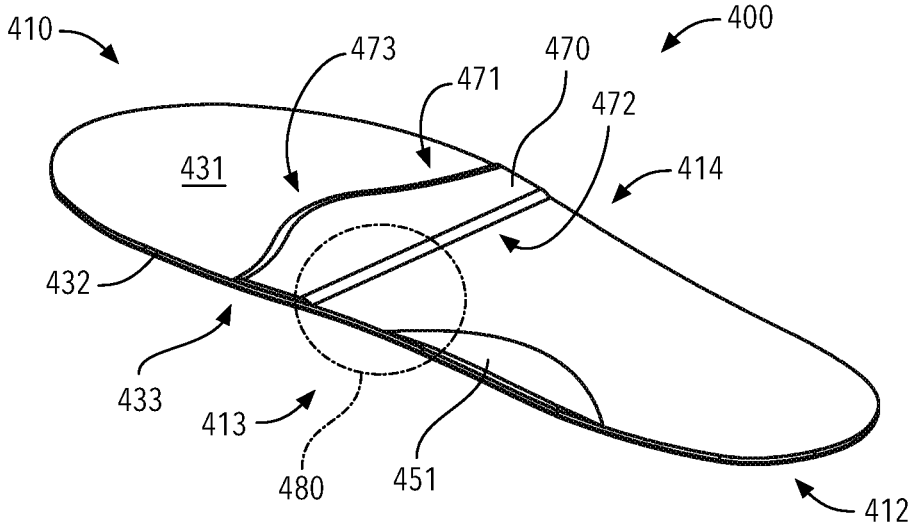
FIG. 8A is a top perspective view of the fourth embodiment of the present invention.
Figure 8B:
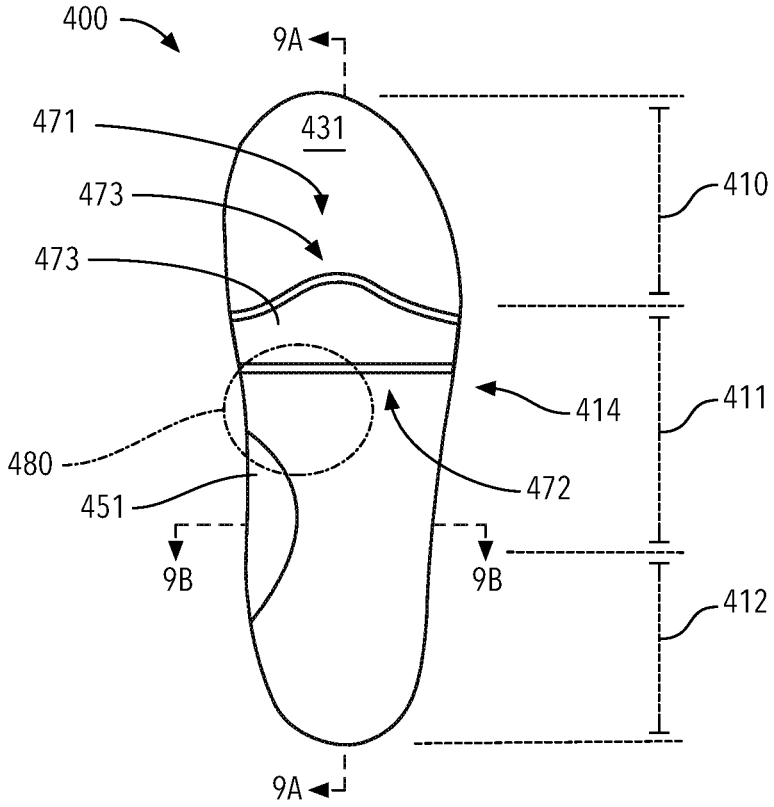
FIG. 8B is a top view of the invention shown in FIG. 8A.
Figure 9A:
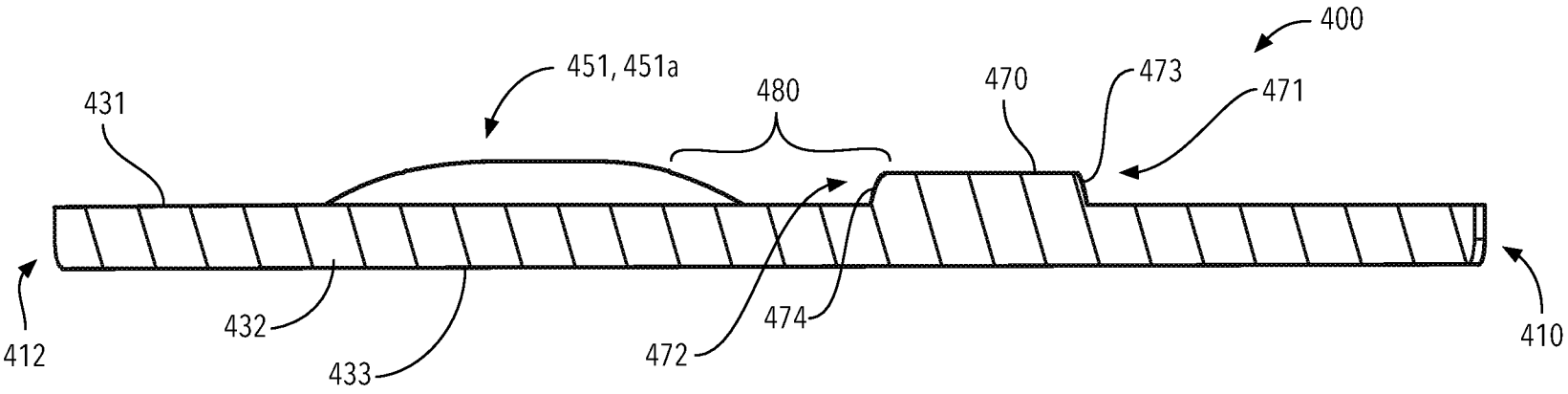
FIG. 9A is a cross-sectional view taken generally along line 9A-9A shown in FIG. 8B; and, FIG. 9B is a cross-sectional view taken generally along line 9B-9B shown in FIG. 8B.
Figure 9B:
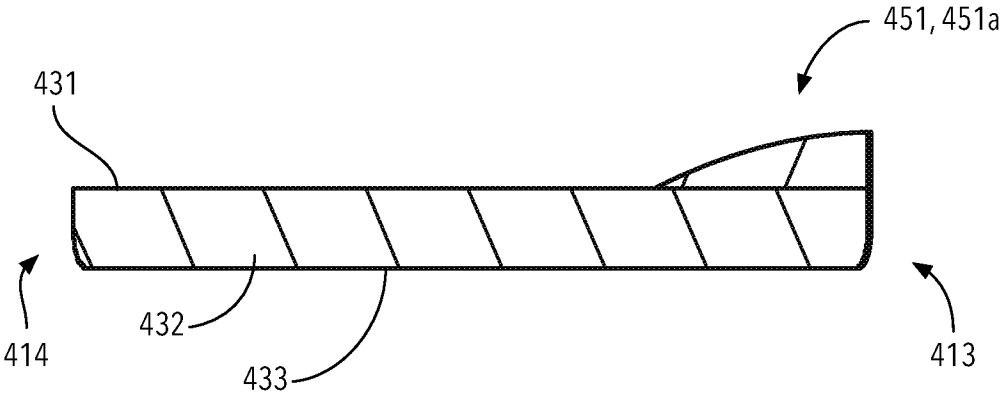

Adverting now to the fourth embodiment of the present invention, insole 400. The following description should be taken in view of FIGS. 8A-9B. FIG. 8A illustrates a perspective view of insole 400 and FIG. 6B illustrates a top view of insole 400. FIGS. 9A and 9B illustrate a cross-sectional view of insole 400 taken generally along lines 9A-9A and 9B-9B in FIG. 8B, respectively. Base layer 433 and middle layer 432, are adhered to top layer 431 via a double-sided adhesive tape, although it should be appreciated that various other methods of binding the base layer and the top layer may be employed, e.g., heat lamination, or other suitable means. It should be appreciated that middle layer 432 is illustrated to depict the material between base layer 433 and top layer 431 (shown in greater detail in view of FIGS. 9A and 9B).

Insole 400 is defined by forefoot region 410, midfoot region 411, and hindfoot region 412. Specifically, forefoot region 410 is defined by the toes of the foot of the user, that is, the area where the toes will rest thereon, midfoot region 411 is defined by the arch of the foot of the user and hindfoot region 412, defined by the heal of the foot of a user, that is, the area where the heal will rest thereon. Insole 400 includes two sides, inside arch 413 and outside arch 414, where inside arch 413 would be arranged proximate to the inside arch of a user's foot resting on insole 400 and where outside arch 414 would be arranged proximate to the outside arch of a user's foot resting on insole 400.

Insole 400 also comprises inside arch projection 451 and is arranged to have a substantially semicircular configuration, a semi-domed configuration, or a combination thereof. Inside arch projection 451 is preferably located in insole 400 proximate to hindfoot region 412 and partially within midfoot region 411 of insole 400.

Arch projection 451 could be integral with top layer 431 and middle layer 432. Alternatively, inside arch projection 451*a* could be a separate component that are affixed to top layer 431, as shown in FIG. 9B.

Insole 400 also includes midfoot projection 470. Midfoot projection 470 has a quadrilateral-like shape and has toe end 471 and midfoot end 472. Arranged proximate to midfoot end 472 is midfoot slope 474. Midfoot slope 474 has a straight configuration such that it bifurcates insole 400 within midfoot region 411. Arranged proximate to toe end 471 is toe slope 473. Toe slope 473 has a curved arrangement, unlike midfoot slope 474, where the curve juts outwardly in a substantially central position horizontally and the jut is proximate to forefoot region 410. Midfoot projection may be arranged to extend upwardly from top layer 431 or could be a protrusion extending from middle layer 432 that is covered by top layer 431.

Arch projection 451, midfoot projection 470, and top layer 431 collectively create wedge 480. Wedge 480 is preferably arranged proximate inside arch 413 and within midfoot region 411. The benefits imparted by the configuration of wedge 480 are described in greater detail, infra.

The following description should be taken in view of all of the aforementioned figures. The first and second embodiments of the present invention, insoles 100 and 200 are configured to enhance physical and mental performance, via frequency imparted through the foot of user contacting either insole 100 or 200. This frequency stimulates nerve centers to intensify muscle tone, stability, and mobility. A constant stimulation to the nervous system allows the human brain to create new neural pathways. Feedback from the skin of a person's foot is a primary source of sensory input. This sensory input is supplied to the brain from approximately 100,000 to 200,000 receptors in the sole of each human foot. Limiting the sensory inputs from human feet has been shown to introduce issues of maintaining stability and balance. Pressure projection 20 of insoles 100 and 200 are arranged to provide sensory feedback through a user's foot through constant contact with pressure projection—resolving the issue of losing sensory input that could hinder maintaining stability and balance.

Pressure projection 20 of insoles 100 and 200 provide constant sensory input to a user's nervous system. The constant stimulation of pressure projection allows a user's brain to create new neural networks to resolve poor postural habits that may be introduced from sensory input deprivation. Pressure projection 20 works by:

1. The signal, or sensory input, from the skin of a user's foot travels to their brain through channels known as the ascending sensory pathways;
2. The signal arrives in a user's sensory cortex of the brain, located in your parietal lobe;
3. The signal is then transmitted to the motor cortex located in the frontal lobe;
4. The frontal lobe is the center where a user's brain plans the execution of movement; and,
5. Pressure projection 20 has a configuration that optimizes the signal to provide for accurate movement and proper alignment.

In a study conducted on Mar. 10, 2022, force plate measurements were taken of a member of a law enforcement organization. The measurements were taken of both the right and left feet. The test was conducted with the person wearing insoles without pressure projection 20 and subsequently wearing insole 100. The following chart illustrates the benefits imparted on the law enforcement personal via pressure projection 20 of insole 100. Shown below are the differences measured by the force plate of the law enforcement personal without insole 100 and with insole 100:

Blood Pressure & Grip Strength:

| | Without Insole 100 | With Insole 100 |
|---|---|---|
| Blood Pressure | 158/105 | 138/100 |
| Grip Strength | 151 lbs. | 154 lbs. |

Foot Posture (Weight Distribution %) without Insole 100:

| | Left Foot | Right Foot |
|---|---|---|
| Overall | 52.3% | 47.7% |
| Toes | 27.7% | 18.4% |
| Heel | 24.6% | 30.0% |

It should be noted that a perfect foot posture will distribute the overall weight evenly across the left and right feet, i.e., 50% and 50%, and the respective distribution between the toes and heel of perfect foot posture will be distributed evenly across the toes and heel of the respective foot, i.e., 25% and 25%.

Foot Posture (Weight Distribution %) with Insole 100:

| | Left Foot | Right Foot |
|---|---|---|
| Overall | 51.6% | 48.4% |
| Toes | 22.9% | 23.3% |
| Heel | 28.8% | 24.4% |

In the second, third, and fourth embodiments of the present invention, insoles 200 and 300, and 400 all include inside arch projection 251 (or inside arch projection 251*a*), and outside arch projection 252 (or outside arch projection 252*a*). In the second and third embodiments of the present invention, insoles 200 and 300 include inside arch projections 251 and 351 and outside arch projections 252 and 352, respectively. If a user of insoles 200 or 300 have his or her rear-foot (heel) poorly stimulated, the user's foot sole receptors are missing vital information from sensory inputs, as described supra, which could result in poor activation of the user's posterior chain. When a user has a rearfoot stimulation deprivation, a common indicator is a forward center of mass of the user. The forward center of mass leads to an array of compensations by the body and brain, thereby requiring the user to expend greater energy in order to stay upright against gravity.

It should be appreciated that inside arch projection 251 and outside arch projection 252, referenced herebelow, should also be taken in consideration of inside arch projection 351 (or 351*a*) and outside arch projection 352 (or 352*a*) of insole 300. Inside arch projection 251 (or inside arch projection 251*a*), and outside arch projection 252 (or outside arch projection 252*a*) of insoles 200 collectively form wedge 260 (or wedge 360 of insole 300). Wedges 260 is arranged to stimulate the receptors in a user's rear-foot that is contacting insole 200 as wedge 260 imparts a deep pressure and stretch to the rear-foot of a user, as follows:

1. The signal, or sensory input received from the skin of a user's foot travels to the user's brain through ascending sensory pathways;
2. This signal arrives in the user's sensory cortex of their brain, located in their parietal lobe;
3. The signal is then transmitted to the motor cortex located in the frontal lobe.
4. The frontal lobe is the center where a user's brain plans the execution of movement; and,
5. The improved signal allows the user's brain to command proper tonicity of the user's posterior chain—encouraging a neutral center of mass and optimal joint mechanics of movement.

Insole 400 includes inside arch projection 451 and midfoot projection 470, which collectively create wedge 480. Common ailments such as rounded shoulders, tight traps, or the occasional tension headache can be commonly addressed and resolved through engaging the sensory receptors in the foot, particularly the midfoot. When the arches of the foot are poorly stimulated, the individual's receptors are necessarily missing essential signaling information that should be communicated to the brain, which in turn means the brain cannot orchestrate proper alignment, specifically in the individual's lower extremities and pelvis. Other ailments include knocked knees and protruding abdomens, i.e., anterior tilt. Wedge 480 resolves these issues by:

1. The signal, received from the skin of a user's foot travels to the user's brain through ascending sensory pathways;
2. This signal arrives in the user's sensory cortex of their brain, located in their parietal lobe;
3. The signal is then transmitted to the motor cortex located in the frontal lobe;
4. The frontal lobe is the center where a user's brain plans the execution of movement; and,
5. The improved signal provided by wedge 480 allows the user's brain to optimize knee alignment while encouraging a neutral pelvis tilt—inducing a positive, less detrimental, impact on the user's joints.

It should be appreciated that the embodiments as shown are only one of a variety of possible embodiments of the claimed invention.

It will be appreciated that various aspects of the disclosure above and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims.

REFERENCES NUMERALS

| | |
|---|---|
| 10 | Forefoot region |
| 11 | Midfoot region |
| 12 | Hindfoot region |
| 13 | Inside arch |
| 14 | Outside arch |
| 20 | Pressure projection of insole 100 and 200 |
| 20a | Bulge |
| 21 | Base of pressure projection 20 |
| 21a | Upper surface of base 21 |
| 21b | Attachment location of annular ring 22 |
| 21c | Attachment location of metal insert 23 |
| 22 | Annular ring of pressure projection 20 |
| 22a | Inner edge of annular ring 22 |
| 23 | Metal insert of pressure projection 20 |
| 23a | Outer edge of metal insert 23 |
| 24 | Horseshoe-shaped aperture of metal insert 23 |
| 31 | Top layer |
| 32 | Middle layer |
| 33 | Bottom layer |
| 100 | Insole (first embodiment) |
| 200 | Insole (second embodiment) |
| 210 | Forefoot region of insole 200 |
| 211 | Midfoot region of insole 200 |
| 212 | Hindfoot region of insole 200 |
| 213 | Inside arch of insole 200 |

-continued

REFERENCES NUMERALS

| | |
|---|---|
| 214 | Outside arch of insole 200 |
| 231 | Top layer of insole 200 |
| 232 | Middle layer of insole 200 |
| 233 | Bottom layer of insole 200 |
| 251 | Inside arch projection of insole 200 |
| 251a | Inside arch projection of insole 200 |
| 252 | Outside arch projection of insole 200 |
| 252a | Outside arch projection of insole 200 |
| 260 | Wedge |
| 300 | Insole (third embodiment) |
| 310 | Forefoot region of insole 300 |
| 311 | Midfoot region of insole 300 |
| 312 | Hindfoot region of insole 300 |
| 313 | Inside arch of insole 300 |
| 314 | Outside arch of insole 300 |
| 331 | Top layer of insole 300 |
| 332 | Middle layer of insole 300 |
| 333 | Bottom layer of insole 300 |
| 351 | Inside arch projection of insole 300 |
| 351a | Inside arch projection of insole 300 |
| 352 | Outside arch projection of insole 300 |
| 352a | Outside arch projection of insole 300 |
| 360 | Wedge of insole 300 |
| 400 | Insole (fourth embodiment) |
| 410 | Forefoot region of insole 400 |
| 411 | Midfoot region of insole 400 |
| 412 | Hindfoot region of insole 400 |
| 413 | Inside arch of insole 400 |
| 414 | Outside arch of insole 400 |
| 431 | Top layer of insole 400 |
| 432 | Middle layer of insole 400 |
| 433 | Bottom layer of insole 400 |
| 451 | Inside arch projection of insole 400 |
| 451a | Inside arch projection of insole 400 |
| 470 | Midfoot projection of insole 400 |
| 471 | Toe end of projection 470 |
| 472 | Midfoot end of projection 470 |
| 473 | Toe slope of projection 470 |
| 474 | Midfoot slope of projection 470 |
| 480 | Wedge of insole 400 |

What is claimed is:

1. An insole, comprising:

a base layer;

a top layer fixedly secured to said base layer; and, a pressure projection extending upwardly from within said base layer and forming a bulge in said upper layer, said projection comprising:

a disc fixedly secured to said base layer;

an annular ring fixedly secured atop said disc;

a circular metal insert fixedly secured atop said disc within said annular ring, said circular metal insert having a horseshoe-shaped aperture therein.

2. The insole recited in claim 1, wherein said base layer is a combination of polyurethane and polyamide.

3. The insole recited in claim 2, wherein said top layer is a combination of polyurethane and polyamide.

4. The insole recited in claim 1, wherein said annular ring is comprised of zinc.

5. The insole recited in claim 1, wherein said circular metal insert is comprised of copper.

* * * * *